US010935025B2

(12) United States Patent
Hayes-Pankhurst et al.

(10) Patent No.: US 10,935,025 B2
(45) Date of Patent: Mar. 2, 2021

(54) PUMP ASSEMBLY

(71) Applicant: QUANTEX PATENTS LIMITED, London (GB)

(72) Inventors: Richard Paul Hayes-Pankhurst, London (GB); Jonathan Edward Ford, Cambridge (GB)

(73) Assignee: QUANTEX PATENTS LIMITED, London (GB)

( * ) Notice: Subject to any disclaimer, the term of this patent is extended or adjusted under 35 U.S.C. 154(b) by 262 days.

(21) Appl. No.: 16/076,676

(22) PCT Filed: Feb. 8, 2017

(86) PCT No.: PCT/EP2017/052744
§ 371 (c)(1),
(2) Date: Aug. 8, 2018

(87) PCT Pub. No.: WO2017/137434
PCT Pub. Date: Aug. 17, 2017

(65) Prior Publication Data

US 2019/0048871 A1 Feb. 14, 2019

(30) Foreign Application Priority Data

Feb. 8, 2016 (GB) ..... 1602251

(51) Int. Cl.
*F04C 5/00* (2006.01)
*F01C 5/04* (2006.01)
(Continued)

(52) U.S. Cl.
CPC ..... *F04C 5/00* (2013.01); *F01C 5/04* (2013.01); *F04C 15/0057* (2013.01);
(Continued)

(58) Field of Classification Search
CPC ..... F04C 5/00; F04C 15/0057; F04C 15/06; F04C 15/0015; F04C 2240/20; F04C 2240/30; F01C 5/04
See application file for complete search history.

(56) References Cited

U.S. PATENT DOCUMENTS 2,052,474 A * 8/1936 Johnson ..... F04C 5/00 418/135
2,784,902 A * 3/1957 Glenn ..... F04C 5/00 417/475
(Continued)

FOREIGN PATENT DOCUMENTS

DE 19916252 A1 11/2000
FR 2129654 A5 10/1972
(Continued)

*Primary Examiner* — Charles G Freay

(57) ABSTRACT

A pump assembly comprising a housing, a support frame that can be attached to the housing, and a rotor that can rotate within the housing. The housing consists of resilient material and comprises an interior surface, an inlet portion including an inlet for fluid, an outlet portion including an outlet for the fluid, and a diaphragm portion. A housing-engaging surface area of the rotor will form a sealing interference contact with the interior surface, and a chamber-forming surface area of the rotor disposed radially inward from the housing-engaging surface area will form a chamber with the interior surface. When the rotor rotates within the housing as in use, the chamber can convey fluid from the inlet portion to the outlet portion. The diaphragm portion will bear against the chamber-forming surface as the chamber-forming surface travels from the outlet to the inlet, to prevent fluid passing from the outlet to the inlet and to expel the fluid from the chamber through the outlet portion. The support frame will be attached to spaced-apart portions of the housing, and will be sufficiently stiff to counter-balance the torque applied to the housing by the rotor.

40 Claims, 7 Drawing Sheets

(51) Int. Cl.
*F04C 15/00* (2006.01)
*F04C 15/06* (2006.01)

(52) U.S. Cl.
CPC ..... *F04C 15/06* (2013.01); *F04C 2240/20* (2013.01); *F04C 2240/30* (2013.01)

(56) References Cited

U.S. PATENT DOCUMENTS

| | | | | |
|---|---|---|---|---|
| 3,408,947 | A * | 11/1968 | McMillan | F04C 5/00 418/45 |
| 3,771,901 | A | 11/1973 | Svensson | |
| 9,175,681 | B2 * | 11/2015 | Hayes-Pankhurst | F04C 15/00 |
| 9,638,204 | B2 * | 5/2017 | Hayes-Pankhurst | F01C 19/04 |
| 9,816,520 | B2 * | 11/2017 | Hayes-Pankhurst | B67D 1/10 |
| 2014/0348684 | A1 * | 11/2014 | Hayes-Pankhurst | F04C 5/00 418/129 |
| 2016/0010643 | A1 * | 1/2016 | Hayes-Pankhurst | F01O 5/04 418/139 |

FOREIGN PATENT DOCUMENTS

| | | | |
|---|---|---|---|
| WO | 2013050488 | A2 | 4/2013 |
| WO | 2013117486 | A1 | 8/2013 |

* cited by examiner

PUMP ASSEMBLY

This disclosure relates generally to pump assemblies, particularly for diaphragm pumps comprising rotors.

European patent application publication number 2 422 048 discloses a pump comprising a housing having an interior defining a rotor path, an inlet formed in the housing at a first position on the rotor path, an outlet formed in the housing at a second position on the rotor path spaced from the first position, and a rotor rotatable in the housing. At least one first surface is formed on the rotor and seals against the rotor path of the housing, and at least one second surface is formed on the rotor circumferentially spaced from the first surface and forming a chamber with the rotor path that travels around the rotor path on rotation of the rotor to convey fluid around the housing from the inlet to the outlet. A resilient seal is located on the rotor path and so extends between the outlet and the inlet in the direction of rotation of the rotor such that the first rotor surface seals with, and resiliency deforms, the seal, as the rotor rotates around the rotor path within the housing to prevent fluid flow from said outlet to said inlet past the seal.

There is a need for pumps, particularly diaphragm pumps, and particularly but not exclusively relatively small pumps that can pump fluid at a relatively high rate (for their size), and/or pumps that can pump relatively accurate doses of fluid. The pumps should preferably be capable of being manufactured relatively efficiently.

Viewed from a first aspect, there is provided a pump for pumping fluid (particularly liquid), comprising a housing, a support frame that can be attached to the housing, and a rotor that can rotate within the housing (the rotor can rotate about a longitudinal axis, which may be referred to as the rotor axis); the housing consisting of resilient material and comprising an interior surface, an inlet portion including an inlet for the fluid, an outlet portion including an outlet for the fluid, and a diaphragm portion; in which the housing and rotor are cooperatively configured such that when assembled as in use, a housing-engaging surface area of the rotor will form a sealing interference contact with the interior surface, and a chamber-forming surface area of the rotor disposed radially inward from the housing-engaging surface area will form a chamber with the interior surface (in other words, a chamber will be formed between the chamber-forming surface area on one side, and an area of the interior surface on the opposite side); and when the rotor rotates within the housing as in use, the chamber can convey fluid from the inlet portion to the outlet portion (in other words, the fluid will be contained within the chamber as the chamber rotates between the inlet and outlet portions, the chamber-forming surface area moving relative to the interior surface); the rotor will apply a torque to the housing in response to the housing-engaging surface area rotating against the interior surface; and as the chamber-forming surface travels from the outlet to the inlet, the diaphragm portion will bear against it, operative to prevent fluid passing from the outlet to the inlet, and to expel the fluid from the chamber through the outlet portion; and in which the support frame is configured such that when assembled as in use, it will be attached to a plurality of spaced-apart portions of the housing, and be sufficiently stiff to counter-balance the torque applied to the housing by the rotor (the support frame will connect the spaced-apart portions, which will be spaced apart by a portion or volume of the housing; the support frame may comprise a plurality of frame members that will be attachable to each other).

The support frame will be configured operative to resist or substantially prevent movement or deformation of (at least) the spaced-apart portions of the housing relative to each other and/or relating to the rotor axis in use; particularly but not exclusively from moving or deforming azimuthally, or rotationally about the rotor axis in response to the rotation of the rotor in use. The support frame may be attachable to a rotor drive mechanism for driving the rotor to rotate, operative to prevent the support frame from rotating about the rotor axis in response to the rotation of the rotor in use.

At least a portion of the housing adjacent an area of the interior surface against which pumped fluid will be conveyed within the (moveable) chamber, will be sufficiently stiff for the interference contact with the housing-engaging surface area of the rotor to contain the pumped fluid at a desired pressure (of the fluid). Given the resilient material of the housing (and ranges of other operating conditions, such as temperature), the stiffness of at least a portion of the housing, such as a wall portion, may be determined by its volume or thickness, all else being equal.

Viewed from a second aspect, there is provided one or more parts for an example disclosed example pump assembly. For example, the set of parts may include one or more of a housing, a rotor, a support frame, members of a support frame assembly, and a resilient biasing mechanism.

Viewed from a third aspect, there is provided a fluid-carrier device configured for connection to an example disclosed pump. For example, the fluid-carrier device may comprise a tube, hose, pipe or container vessel.

Viewed from a fourth aspect, there is provided a fluid-conveyer assembly comprising an example pump assembly, and an inlet and/or an outlet fluid-carrier device. For example, the fluid-conveyor assembly may be for conveying industrial liquids in a manufacturing plant, medicinal or bodily fluids in a hospital, surgical or home environment, or consumable fluids.

Various pump assembly arrangements and combinations of features are envisaged by this disclosure, non-limiting and non-exhaustive examples of which are described below. Example pump assemblies may be in assembled form as in use, in kit form, or in partially assembled form.

In some example arrangements, at least two spaced-apart portions may be adjacent (or coterminous with) respective proximal and distal ends of the housing; and/or adjacent (or coterminous with) mutually remote ends and/or areas of the housing. In some examples, the diaphragm portion, and/or a cavity within the housing for accommodating the rotor may be located between at least two spaced-apart portions; in some examples, a (notional) straight line segment connecting at least two spaced-apart portions may pass through the diaphragm portion and/or the cavity. In some examples, the support frame may be attachable to (and connect) two, three or more spaced-apart portions; for example it may be attachable to three or four spaced-apart portions. In some example arrangements, an area of the interior surface may be located between the spaced-apart portions.

In some example arrangements, the spaced-apart portions of the housing may comprise or consist of the inlet and outlet portions. In other words, the support frame may be attached to both the inlet and outlet portions of the housing. One of the spaced-apart portions of the housing may include a rotor port, for receiving a part of a rotor drive mechanism or a drive shaft for the rotor.

In some examples, the support frame may resist or substantially prevent the inlet and outlet portions from moving about the rotor axis in response to the rotor rotating as in use;

and/or the inlet and outlet portions may be substantially prevented from moving relative to each other about the rotor axis.

In some example arrangements, the support frame may be configured and sufficiently stiff to substantially prevent the housing, or at least a portion of the housing, from being stretched or compressed in response to a force applied to the housing by one or more fluid carrying device attached to the housing. For example, one of the inlet and outlet portions may be coupled with a first fluid-carrying device (for example, a fluid container vessel) and the other of the inlet and outlet portion may be coupled with a second fluid-carrying device. The support frame may be attached to the inlet and outlet portions, and attached to the first and second fluid carrying devices, such that the inlet and outlet portions of the housing would be indirectly coupled to the first and second fluid-carrying devices via attachment to the support frame. The pump assembly may hang from the first fluid-carrying device, and the second fluid carrying device may hang from the pump assembly, thus applying a tensile force to the support frame. The support frame may sustain substantially the entire tensile force (in this example induced by gravity) and prevent the housing from being substantially stretched.

In some example arrangements, the support frame may be configured such that when assembled as in use, it may be attached to a wall portion of the housing, between the inlet and outlet portions (as used herein, "attached" may include contacting such that relative movement will be resisted or substantially prevented). In some example arrangements, the support frame may be attached to a body portion of the housing including the diaphragm portion and a wall portion, and located between the inlet and outlet portions. The volume of the body portion may be sufficiently large (for example, the wall portion may be sufficiently thick) that the diaphragm portion will be prevented from substantially moving or deforming (azimuthally) about the rotor axis in response to the rotation of the rotor in use.

In some example arrangements, the support frame may be configured such that when assembled as in use, it may be attached to the inlet portion, the outlet portion, and a rotor drive mechanism (such as a drive shaft) for rotating the rotor, operative to resist or substantially prevent movement of the inlet and outlet portions relative to the rotor axis and/or the rotor port portion.

The support frame may comprise ports for the inlet portion, the outlet portion and a rotor drive shaft. When assembled as in use, the port for the rotor drive shaft may provide a passage through which a drive mechanism can apply torque to drive the rotor to rotate within the housing. The drive mechanism may be external to the support frame. In some example arrangements, the support frame (which may comprise or consist of an assembly of two, three or more inter-connectable support frame members) may comprise a rotor port portion that includes a rotor port to allow the rotor drive shaft to pass through the support frame in use.

In some example arrangements, the spaced-apart portions of the housing (to which the support frame will attach) may comprise the inlet and outlet portions, and there may be a gap between an external surface of the housing and the port provided in the support frame for the rotor drive shaft.

In some example arrangements, the rotor may comprise or be coupled to a rotor drive shaft, and the support frame may comprise a rotor port portion including a rotor port; the rotor drive shaft and the support frame being cooperatively configured such that the rotor drive shaft can be rotatably connected to the rotor port portion. For example, the rotor drive shaft may comprise a circular flange or groove extending circumferentially, such that when the rotor drive shaft rotates as in use, the flange or groove will rotate against an internal or external surface of the rotor port portion, adjacent the rotor port.

The support frame may comprise a rotor attachment mechanism so that the support frame can be attached to a rotor drive mechanism for driving the rotor to rotate, and operable to prevent the support frame from rotating in response to the torque applied by the rotating rotor onto the housing.

Some example pump assemblies may comprise a plurality of support frames, cooperatively configured with each other and with the housing, such that when assembled as in use, different support frames may be attached to different portions of the housing. Different support frames may resist or substantially prevent relative movement between different portions of the housing, and/or movement of the different portions of the housing about the rotor axis in use. For example, a first support frame may be attachable to the inlet and outlet portions, and a second support frame may be attachable to a wall portion of the housing between the inlet and outlet portions; and/or may provide a seat for contacting and/or supporting a resilient biasing means. In some examples, the plurality of support frames may be attached to, or contact each other, and in some examples, they may be separated from each other. In various examples, the plurality of support frames may non-movably attached to each other, rotationally or pivotably attached to each other, or translationally attached to each other; attachment of support frames to each other may comprise or consist of contact between them.

The cavity may have opposite ends connected by the interior surface, and one or both of the ends may be open (when the rotor is not present within the housing). The rotor may be elongate, and it may have a pair of opposite ends connected by a side surface which may include cylindrical and/or conical areas. The side surface of the rotor may include one, two, three or four (or more) chamber-forming surface areas, each set radially inwardly from the housing-engaging surface area. One or more, or all of the chamber-forming surfaces may be entirely or partly surrounded by the housing-engaging surface area; the side of the rotor may comprise a single contiguous housing-engaging surface area, surrounding each of the chamber-forming surfaces. Housing-engaging surface areas adjacent either end of the rotor may extend circumferentially all the way around the rotor, thus preventing fluid from passing from the chamber to either end of the cavity.

In some example arrangements, the housing may be configured such that it is not sufficiently stiff to resist being rotated or azimuthally or rotationally deformed torsionally in response to the torque (in the absence of the support frame). For example, the volume or wall thickness(es) of the housing may not be sufficient to prevent the inlet portion, and/or the outlet portion, and/or the diaphragm portion, and/or the interior surface from moving, rotating or distorting relative to the rotor axis and/or relative to each other in response to the rotation of the rotor in use (i.e. without the support frame). The support frame may comprise or consist of material having a substantially higher elastic or flexural modulus, and/or hardness than the resilient material of the housing.

In some example arrangements, the support frame may be configured to be sufficiently stiff to resist movement of the inlet and outlet portions relative to each other in response to the rotation of the rotor as in use. The stiffness (which may also be referred to as the rigidity) of the support frame will depend on the material of which it is formed, as well as its shape and volume. For example, a sufficiently high stiffness of the support frame may be achieved by using material having a relatively high elastic or flexural modulus, and/or high hardness on the one hand, and a relatively low support frame volume on the other, or vice versa, depending on given design criteria. The support frame may comprise or consist of material having Young's, elastic or flexural modulus, or hardness of at least 2, or at least 10, or at least 100 times that of the resilient material of the housing.

In some example arrangements, the housing may be configured such that it will reversibly distend in response to the sealing interference contact with the housing-engaging surface of the rotor. This may have the aspect of enhancing the seal between the housing-engaging surface area of the rotor and the interior surface of the housing, and consequently reducing the risk of fluid leaking from within the chamber at relatively higher fluid pressure.

In some example arrangements, the support frame may comprise or be attachable to at least one coupling mechanism for connecting the inlet and/or outlet portions to a fluid-carrier device. For example, the coupling mechanism may comprise a hose fitting, a threaded nozzle, a luer fitting, a male or female coupling adapter, or a clamping mechanism, for connecting the inlet and/or outlet portion to a fluid-carrier device comprising a cooperating coupling mechanism. In some example arrangements, the pump assembly may include at least one coupling mechanism for coupling the inlet and outlet portions to respective fluid carrying devices.

In some example arrangements, the pump assembly may comprise a mechanism for combining the pumped fluid with a second fluid. The second fluid may be combined with the pumped fluid in or proximate the inlet and/or the outlet portion, and/or within the cavity of the housing. The housing may comprise a second inlet, a passage or an aperture for conveying the second fluid to be combined with the pumped fluid.

In some example arrangements, the outlet and inlet portions may be oriented in substantially different directions relative to each other, operative to the pump receiving fluid flowing in one direction through the inlet portion and expelling fluid through the outlet portion in a substantially different direction. For example, the outlet portion may be oriented substantially perpendicular to the direction of the inlet portion. The inlet and the outlet portions may be substantially coaxial or substantially not coaxial; for example, the inlet and the outlet portions may have respective longitudinal axes, which may be substantially parallel to each other, but spaced apart so that the inlet and outlet portions are not co-axial.

In some example arrangements, the support frame may be attachable to a rotor drive mechanism for driving the rotor to rotate; and it may be sufficiently stiff to resist or substantially prevent relative movement of the inlet portion, the outlet portion and the rotor drive mechanism when the rotor rotates as in use. In some example arrangements, the support frame may be attachable to an object that can be held substantially stationary relative to one or more of the fluid carrying devices to which the inlet and/or outlet portions will be connected. In some example this object may comprise a rotor drive mechanism for driving the rotor to rotate in use. For example, the rotor drive mechanism may comprise a motor that drives a shaft to rotate, the rotor being mated with the shaft, or coupled with it in some other way. In some example arrangements, the rotor may comprise the drive shaft; the drive shaft may be an extension of the rotor, and may form a unitary component with the (rest of the) rotor, configured such that when assembled as in use, the drive shaft may project through a rotor port portion that includes a port for the rotor drive shaft. The support frame may be attachable to a rotor drive mechanism such that the support frame will maintain a substantially fixed spatial relationship with the rotor drive mechanism, operative to resist or substantially prevent the support frame from rotating in response to the torque applied by the rotor onto the housing. Thus, as the rotor rotates within the housing and applies a torque to it, the support frame may be substantially prevented from rotating about the rotor axis. In other words, the housing may be secured indirectly to a rotor drive mechanism via the support frame. The support frame may be attachable to the rotor drive mechanism such that it will present the rotor in alignment with rotor drive mechanism and substantially prevent the rotation of the support frame relative to the rotor drive mechanism.

In some example arrangements, the pump assembly may comprise a resilient biasing mechanism for cyclically flexing the diaphragm and urging it against the housing-engaging and chamber-forming surface areas of the rotor, in response to the rotation of the rotor. A proximal side of the resilient biasing mechanism may bear against the diaphragm and reciprocate along a radial direction (passing through the rotational axis of the rotor), and a distal side of the resilient biasing mechanism may be seated against the support frame and held stationary relative to the housing. In some examples, only a section of the proximal side of the diaphragm portion may reciprocate in use, and one or more section adjacent a respective longitudinal end of the diaphragm portion may substantially not reciprocate, since the section may bear against a housing-engaging surface area of the rotor that extends circumferentially all the way around the rotor axis (for example, to prevent fluid in a chamber from escaping longitudinally to the end of the rotor). The support frame may abut a supported external surface area of the housing diametrically opposite the resilient biasing mechanism, operative to apply a counter-balancing reaction force to the housing in response to the reciprocation of the proximal side of the resilient biasing means (in other words, the radial axis of reciprocation of the resilient biasing mechanism may pass through a supported external surface area on the opposite side of the housing). In some examples, the support frame may comprise a seat portion configured to accommodate the distal side of the biasing mechanism, and to contact an adjacent side wall portion of the housing, operative to hold the biasing mechanism in static position relative to the side wall portion.

Some examples of resilient biasing mechanisms may include a coil spring, or an elongate elastomer member, such as an elastomer tube, or a 'U'-shaped elastomer member, which may comprise an elongate rib or projection for bearing onto the diaphragm portion. Some examples of resilient biasing mechanisms may comprise a pneumatic mechanism, or a mechanism comprising compressible fluid. In some examples, the resilient biasing mechanism may comprise some of the pumped fluid being re-directed to apply force onto the diaphragm portion, urging it against a rotor; or it may comprise the same kind of fluid as that being pumped, or a different kind of fluid, being supplied from an external source to apply force onto the diaphragm portion against the rotor.

In some example arrangements, the support frame may be spaced apart from an unsupported external surface area of the housing, operative to allow its deformation in response to the rotation of the rotor, but resist or substantially prevent its azimuthal or rotational movement or distortion about the rotor axis in response to the rotation of the rotor. For example, one or more unsupported external surface areas of the housing may be free to distend or deform in some other way when in use. In examples where the support frame covers or encloses the unsupported external surface area, the volume between the support frame and the housing may contain fluid (gas or liquid). In other examples, the support frame may be configured such that it does not cover or enclose the unsupported external surface area.

In some examples, the support frame may contact a supported external surface area of the housing, in addition to contact at the inlet and outlet portions, and the remaining external surface areas may be unsupported. In various examples, the total unsupported external surface area of the housing may be at least about 20%, at least about 40%, at least about 60% or at least about 80%; and/or at most about 80%, at most about 60%, at most about 40% or at most about 20% of the total external surface area of the housing.

In some example arrangements, the support frame may enclose the housing, wholly or partially enclosing it (apart from ports for accommodating the inlet and outlet portions, and a drive mechanism for the rotor). The support frame may comprise or consist of a single unitary body, or a plurality of frame members that can be assembled and disassembled. For example, the support frame may comprise a pair of frame members, which may substantially be mirror-image half-portions of the support frame (in what may be described as a "clam shell" arrangement); or which may have substantially different sizes or configurations. The frame members may comprise cooperating mechanical, magnetic or other coupling mechanisms such that the frame members can be coupled together with the housing at least partly enclosed between them. When the frame members are assembled as in use, the support frame may comprise ports for at least the inlet and outlet portions, and in some examples for the rotor drive mechanism or shaft.

In some example arrangements, the diaphragm portion may include an aperture through it, such that the outlet or the inlet portion will be in fluid communication with a cavity volume that is coterminous with the side of the diaphragm portion (which may be referred to as the "underside") against which the biasing member will bear in use. Pumped fluid may thus bear against the same side of the diaphragm portion as the biasing member (in other words, on the opposite side of the diaphragm portion as the rotor), with a hydrostatic pressure equal to that of the pumped fluid, and cooperate with the biasing member to urge and flex the diaphragm portion against the rotor. The seal contact between the diaphragm portion and the rotor may thus be enhanced and higher pumping pressures may be possible.

In some example arrangements, the support frame may comprise a seat portion configured for accommodating at least a portion of the resilient biasing mechanism for urging and flexing the diaphragm portion against the rotor in use. The seat portion may comprise one, two or more grooves formed in the support frame or wall-like projections on the support frame. The biasing mechanism may be spaced apart from a wall portion of the housing by a projection formed on the support frame, operative to maintain an azimuthal spatial distance between the biasing mechanism and the wall portion of the housing in use (or expressed in different coordinate system, the lateral distance between the biasing mechanism and the wall portion or portions in a lateral plane that is perpendicular to the rotor axis). This may have the effect of stabilising the spatial relationship between the resilient biasing mechanism and the diaphragm portion, which is contiguous with, and may be adjacent to, the wall portion of the housing.

In some example arrangements, the support frame may comprise a seat portion configured for receiving and supporting a distal side of the biasing member (a proximal side of which will bear against the diaphragm portion in use), and for receiving side wall portions of the housing, configured such that the distal side of the biasing member will be held substantially static relative to the side wall portions. The support frame may comprise a pair of grooves defined by projections or depressions formed on the support frame, for receiving respective side wall portions of the housing. Each side wall portion may be spaced apart from the biasing member by a projection formed on the support frame. Each side wall portion may be adjacent a respective (lateral) side of the diaphragm portion and provide support for a respective side boundary of the diaphragm portion, operative to resist or substantially prevent movement of the side boundaries as a central region of the diaphragm portion reciprocates in use.

In some example arrangements, the support frame may comprise a slot for accommodating a wall portion of the housing that extends from adjacent the diaphragm portion. The slot and the wall portion may be circular, elliptical or rectilinear, for example. The slot may be sufficiently deep that the wall portion can reciprocate within the slot as the housing dynamically distends in response to the rotation of the rotor in use. In other words, there may be a gap between an end of the wall portion (the end may be furthest away from the diaphragm portion) to allow the end to reciprocate, and the sides of the slot may contact the sides of the wall portion so that the wall portion can slide against the sides of the slot, and the sides of the slot may resist or substantially prevent lateral movement or distortion of the wall portion. The slot may substantially prevent azimuthal movement or distortion of the wall portion about the rotor axis in response to the rotation of the rotor (put differently, it may substantially prevent movement of the wall portion or portions laterally in a lateral plane perpendicular to the rotor axis). Wall-like projections formed on the support frame, or depressions in the support frame may form the slot. The support frame may comprise one, two or more slots for the same number of wall portions of the housing.

In some examples, the slot may be configured operative to bear against the wall portion with sufficient force to contain fluid present within the housing. For example, the diaphragm portion may comprise an aperture through it, such that the outlet or the inlet portion will be in fluid communication with a cavity volume that is coterminous with the side of the diaphragm portion (which may be referred to as the "underside") against which the biasing member will bear in use.

The support frame may comprise or consist of thermoplastic polymer material, thermoset polymer material, technical or glass ceramic material, composite material, or metal material (including metal alloys or intermetallic material). For example, the support frame may comprise or consist of one or more of polypropylene, polycarbonate, phenolic or epoxy resin, acetal, polyvinyl chloride (PVC), acrylonitrile butadiene styrene (ABS) or nylon material. In some example arrangements, the support frame may comprise or consist of material having Young's or elastic modulus of at least about 800 MPa, at least about 2,000 MPa, or at least about 4,000 MPa; and/or at most about 500,000 MPa.

In some example arrangements, the diaphragm portion may have substantially uniform or non-uniform thickness;

and it may have a uniform or a mean thickness of at least about 0.1 mm; and/or at most about 3.0 mm or at most about 1.0 mm. In some examples, the mean thickness of the diaphragm portion may be 0.1 mm to about 3 mm, and the mean diameter of the cavity formed by the housing may be about 4 mm to about 5 mm thick, or to about 50 mm thick.

In some example arrangements, the housing may comprise a base wall portion that extends azimuthally between the inlet portion and the outlet portion, and radially from the interior surface to an external surface area of the housing; and the volume and/or thickness of the base wall portion volume may be sufficiently great that pumped fluid having a pressure of up to 700 kPa, up to 500 kPa or up to 200 kPa can be contained within the chamber as the chamber rotates between the inlet portion to the outlet portion. In some example arrangements, the mean thickness of the base wall portion may be at least 4 times, or at least 5 times, and/or up to about 50 times the mean thickness of the diaphragm portion. In some examples, the housing may comprise a body portion, which may comprise the base wall portion and a pair of side wall portions, each contiguous with a respective opposite side of the diaphragm portion at a respective side boundary, in which the side wall portions and the side boundaries extend longitudinally for at least the length of the diaphragm portion. The support frame may be configured such that it will buttress the side wall portions, operative to resist their movement in use. A seat portion of the support frame may be configured to accommodate and buttress the resilient biasing mechanism and the side wall portions in use.

In some example arrangements, the resilient material may comprise elastomer material or thermoset material; and/or the resilient material comprises polyethylene, polypropylene, rubber modified polypropylene, plasticised polyvinyl chloride (PVC), or thermoplastic co-polyester elastomer, silicone rubber, butyl rubber, nitrile rubber, neoprene, ethylene propylene diene monomer (EPDM) rubber, or certain fluoroelastomer materials that may be commercially available under the brand name Viton®.

In some examples, the resilient material may have a Young's, tensile and/or flexural modulus of at least about 1 MPa, at least about 5 MPa, at least about 50 MPa or at least about 100 MPa; and/or the resilient material may have a Young's, tensile and/or flexural modulus of at most about 1,500 MPa.

In some example arrangements, the resilient material may have a nominal Shore D or Shore A hardness (durometer hardness) of 5 to 50; or a hardness of 50 Shore A to 90 Shore D.

In some example arrangements, when the diaphragm portion is flexed in operation, at least part of it may travel a radial distance of at least about 0.2 mm, at least about 0.5 mm or at least about 1 mm; and/or at most about 6 mm, at most about 5 mm or at most about 3 mm.

In some example arrangements, the chamber-forming surface of the rotor may be configured such that it exhibits a concave cross-section in all planes including the axis of rotation, and a convex cross-section in all planes perpendicular to the axis of rotation.

In some example arrangements, the cavity may be substantially cylindrical and coaxial with the rotor axis, the axial length of the chamber-forming surface area formed into the rotor may be 1 to 3 times the diameter of the cavity (for example, about 2 times the cavity diameter), and the rotor may be capable of rotating at least 1 r.p.s, at least 5 r.p.s. or at least 10 r.p.s. and/or at most about 20 r.p.s.

In some examples, the diameter of the cavity may be 0.5 mm to 5 mm; and the pumping rate may be at least 0.01 ml/s, at least 0.2 ml/s or at least 0.4 ml/s, and at most about 0.6 ml/s. In some examples, the diameter of the cavity may be 5 mm to 15 mm; and the pumping rate may be at least 1 ml/s, at least 4 ml/s or at least 10 ml/s, and at most about 15 ml/s. In some examples, the diameter of the cavity may be 0.5 mm to 35 mm; and the pumping rate may be at least 0.01 ml/s, at least 10 ml/s or at least 100 ml/s, and/or at most about 100 ml/s.

In some example arrangements, the housing and the rotor may be configured operative to pump fluid from the inlet to the outlet at a rate of at most about 30 millilitres per second (ml/s) when the rotor rotates at about 10 to about 20 revolutions per second (r.p.s.), at about 15 r.p.s.; and the rotor may have a mean diameter of about 15 to about 20 mm, or about 19 mm. In some example arrangements, the housing and the rotor may be configured operative to pump fluid from the inlet to the outlet at a rate of at most about 0.5 millilitres per second (ml/s) when the rotor rotates at about 10 to about 20 revolutions per second (r.p.s.).

Example pumps may comprise two or three chambers (boluses), each bolus may have a volume of about 1 to 10 microlitres (μl), and may pump fluid at a rate of about 0.02 to 0.3 millilitres per second at a rotor rotation rate of about 10 r.p.s. One example pump may comprise a rotor that forms two chambers (or boluses), each having a volume of about 1 microlitre (the combined volume of the boluses will therefore be about 2 microlitres, and the rotor may rotate at a speed of about 10 r.p.s., resulting in a pumping rate of 20 μl/s (10 r.p.s.×2 μl/revolution). Another example pump may comprise three boluses, each having a volume of about 10 microlitres (the combined volume of the boluses will therefore be about 30 microlitres), and the rotor may rotate at a speed of about 10 r.p.s., resulting in a pumping rate of about 300 μl/s (10 r.p.s.×30 μl/revolution).

In some example arrangements, the mean diameter of the cavity may be at least about 1 mm; and/or at most about 50 mm, or at most about 20 mm. The interior surface (and the rotor) includes a substantially cylindrical or a substantially conical area.

In some example arrangements, the mean diameter of the cavity may be 1 to 10 mm and the resilient material has a Young's, tensile and/or flexural modulus of at most 200 MPa.

For example, the resilient material may have elastic, tensile and/or flexural modulus of about 4 MPa to about 10 MPa, and comprise or consist of rubber having a Shore A hardness of about 60 to 80, or about 70; the strain experienced by the material may be relatively low in such examples. In some examples, the mean diameter of the cavity may be 1 mm to 10 mm and the resilient material may have a Young's, tensile and/or flexural modulus of at least about 4 MPa and at most about 2,000 MPa, at most about 1,500 MPa or at most about 200 MPa. In some examples, the diameter of the cavity may be up to about 50 mm.

In some example arrangements, the pump assembly may be configured such that the rotor can be driven to rotate in either direction about the axis, operative to selectively pump fluid from the inlet to the outlet, or from the outlet to the inlet, in response to the direction of rotation of the rotor. When assembled, the pump may be symmetrical about a plane between the inlet and the outlet portions, and including the axis of rotation of the rotor. The inlet and outlet portions will therefore be identifiable based on the direction of rotation of the rotor and consequently the direction in which the fluid will pumped. Such example pumps may be referred to as bi-directional pumps.

Example pump arrangements will be described with reference to the accompanying drawings, of which FIG. 1A to FIG. 1E show various perspectives and aspects of an example pump assembly:

Figure 4A:
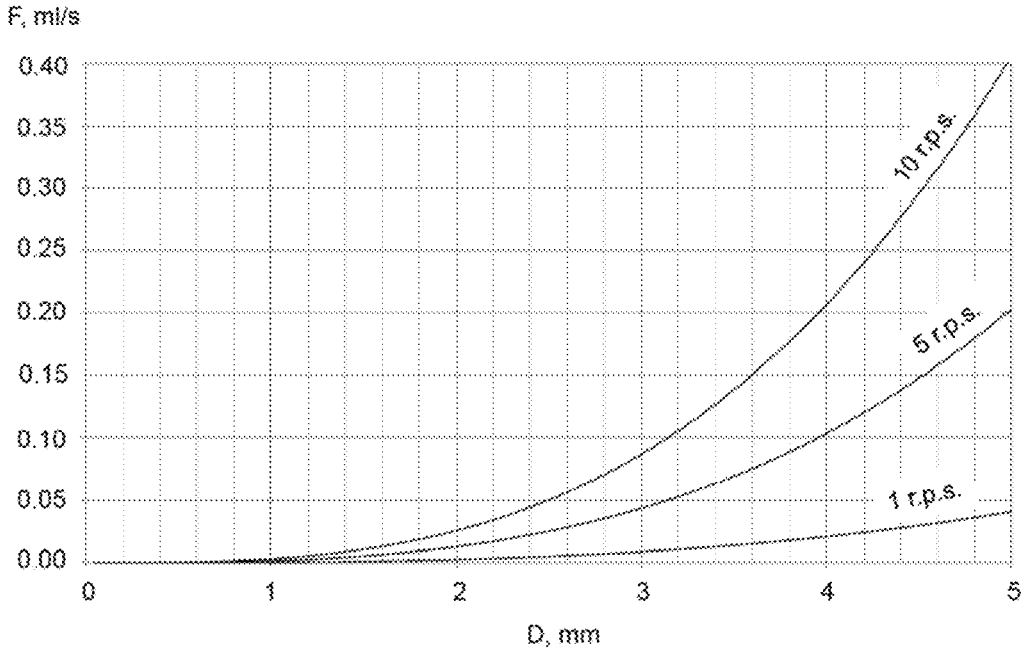
Figure 4B:
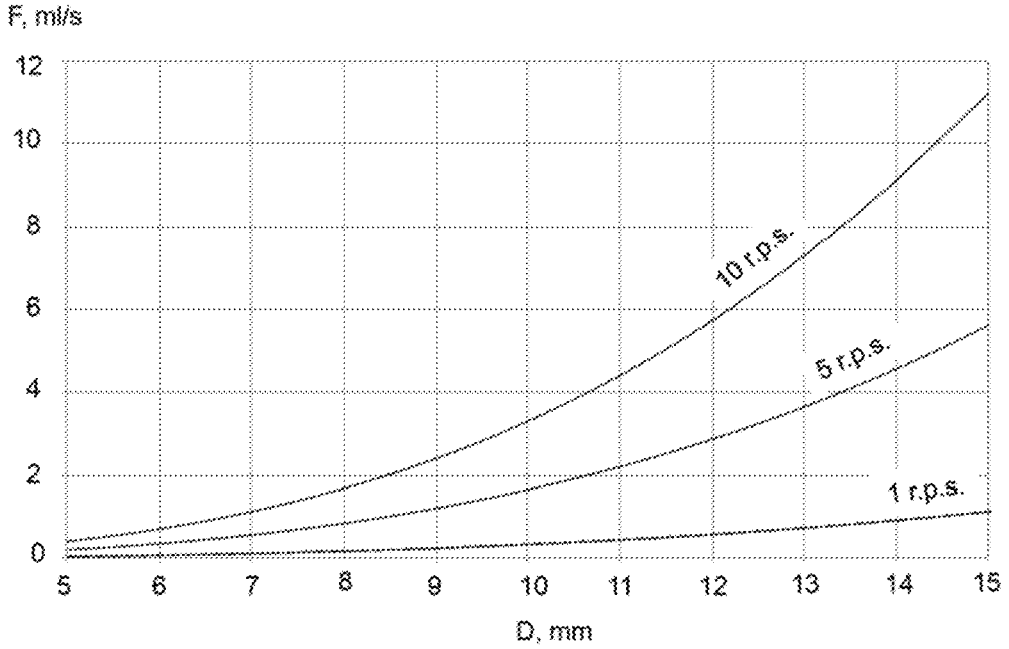
Figure 4C:
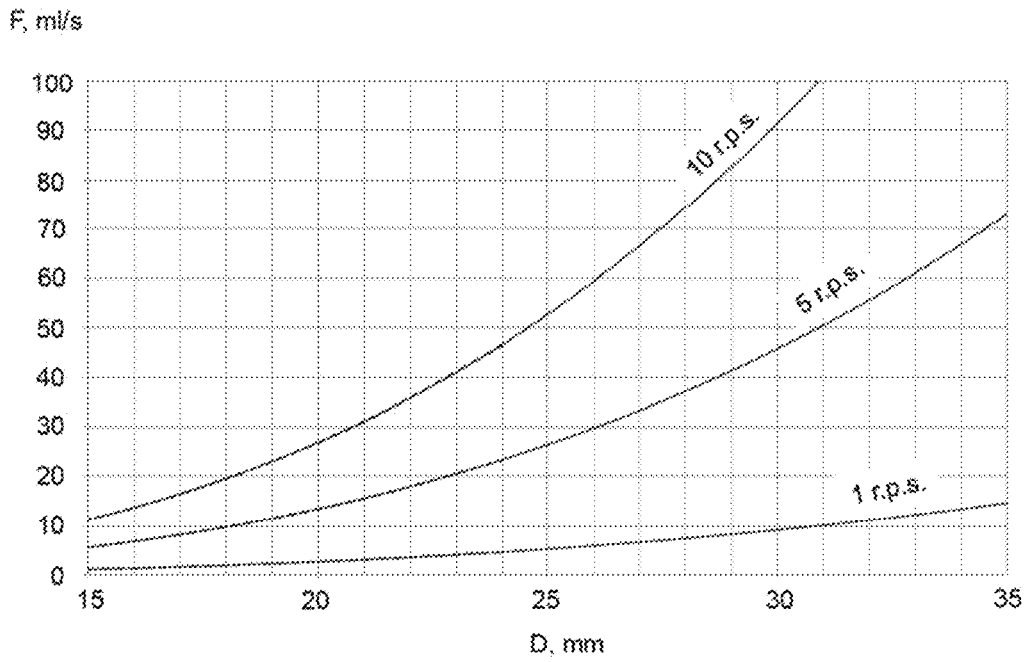

FIG. 4A shows three curves of example fluid flow rate F, in ml/s, versus diameter D, in mm, of a cylindrical rotor from just greater than 0 mm to 5 mm, in an example pump assembly in use, the three curves corresponding to rotor rotation frequencies of 1, 5 and 10 revolutions per second (r.p.s.), in which the length of the rotor is double its diameter; FIG. 4B shows similar curves for rotor diameters in the range of 5 mm to 15 mm; and FIG. 4C shows similar curves for rotor diameters in the range of 15 mm to 30 mm.

With reference to FIG. 1A to 1E, an example arrangement of a pump assembly in assembled condition (except in FIG. 1E, in which the rotor 300 is not shown), suitable for pumping liquid from a supply device (not shown) such as a tube into another device for conveying or containing fluid (not shown). A particular example pump assembly may comprise a housing 100 consisting of thermoplastic material such as polypropylene or plasticised PVC, and a support frame 200 consisting of polycarbonate or acetal material.

The housing 100 comprises a cylindrical cavity 120 defined by an interior surface and in fluid communication with the inlet of the inlet portion 102A on one side, and the outlet of the outlet portion 102B on the opposite side. The housing 100 also comprises a flexible diaphragm portion 110 disposed between the inlet and outlet portions 102A, 102B, and coterminous with the cavity 120. The diaphragm portion 110 is in the form of an elongate membrane having a substantially uniform thickness T and extending parallel to the longitudinal axis L. In the particular example shown, a pair of elongate side wall portions 114A, 114B of the housing 100 are adjacent the inlet and outlet portions 102A, 102B, respectively, and adjacent opposite respective side boundaries of the diaphragm portion 110. The side wall portions 114A, 114B are about four times thicker than the thickness T of the diaphragm portion 110 in order to support the side boundaries of diaphragm portion 110 and reduce movement when the rotor 300 rotates in use. A base wall portion 112 of the housing 100 extends azimuthally between the inlet and outlet portions 102A, 102B, and radially from the interior surface defining the cavity 120 and an external surface of the housing (an area of which is shown in contact with the support frame at 510).

Figure 1A:
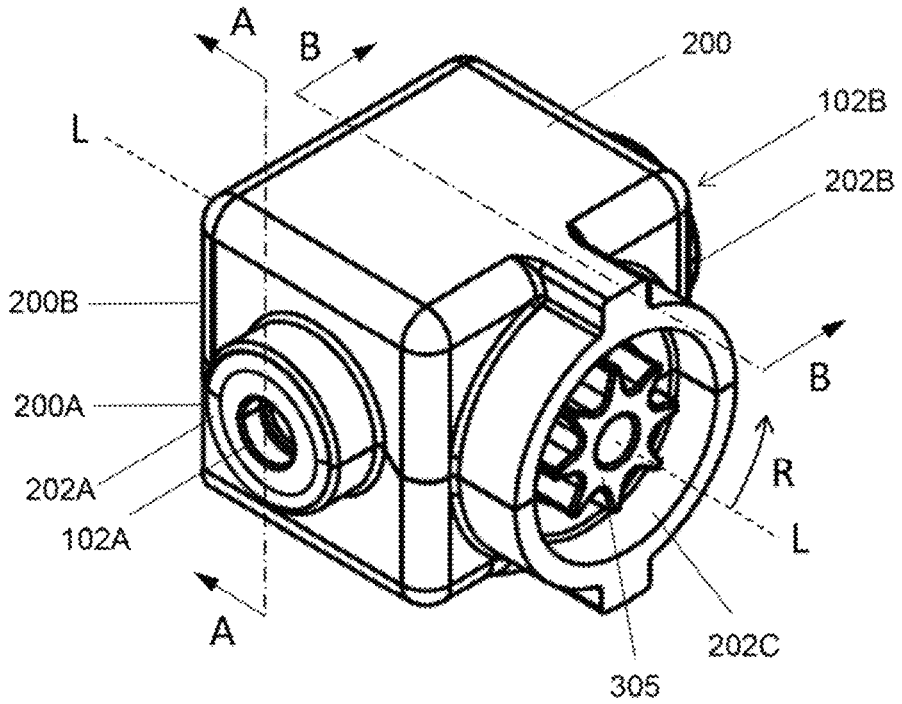
FIG. 1A shows a schematic external perspective view of an example pump assembly in assembled condition as in use.

In FIG. 1A, the inlet portion 102A of the housing 100 is visible and an outlet portion 102B is indicated on the opposite side of the pump assembly (not visible in FIG. 1A). In this example, the support frame 200 is generally cubic in shape and encases substantially the entire housing 100 within it (ends of the inlet and outlet portions 102A, 102B are visible). The inlet and outlet portions 102A, 102B are coaxial with each other, each including a tubular portion extending inwards from opposite sides of the pump assembly, each funnelling down to respective rectangular slits where they join the cavity 120, as shown in FIG. 1E. The inlet and outlet portions 102A, 102B are accommodated by respective cylindrical ports 202A, 202B provided in the support frame 200. The inner diameter of the ports 202A, 202B in the support frame 200 substantially matches the outer diameter of the inlet and outlet tubes 102A, 102B. Each of the ports 202A, 202B is mechanically attached to a respective inlet and outlet tube 102A, 102B, each of which fit coaxially within the respective rigid port 202A, 202B. Each of the ports 202A, 202B supports the respective inlet and outlet portion 102A, 102B, and enables it to be connected to the device for supplying or draining pumped fluid. Also visible in FIG. 1A is a splined mechanism 305 for driving a rotor 300, which will rotate in use in an anti-clockwise direction R about a longitudinal axis L that is perpendicular to the direction in which the fluid will be pumped from the inlet portion 102A to the outlet portion 102B. The support frame 200 comprises an attachment dock 202C for accommodating a rotor drive mechanism 305 for driving the rotor 300. The support frame 200 is sufficiently stiff to maintain the relative positions of the inlet portion 102A, the outlet portion 102B and the rotor drive mechanism 305 when the rotor 300 rotates as in use. The support body 200 in this example may consist of a pair of opposite members 200A, 200B, which may be similar but not necessarily identical, and which may be provided separately and attached to each other to substantially enclose the housing 100 and rotor 300. For example, the opposite halves 200A, 200B of the support body 200 may include a mechanical mechanism for snapping them together around the housing. It can be seen that this example pump is symmetrical about the plane B-B that passes between the inlet and outlet, and includes the axis of the rotor 300. In use, the direction of rotation R of the rotor 300 will be such that an area on its side surface will rotate past the diaphragm portion 110 as it travels from the outlet portion 102B to the inlet portion 102A (in other words, the inlet and outlet portions 102A, 102B can be identified solely by their positions in relation to the direction of rotation R or the rotor 300).

Figure 1B:
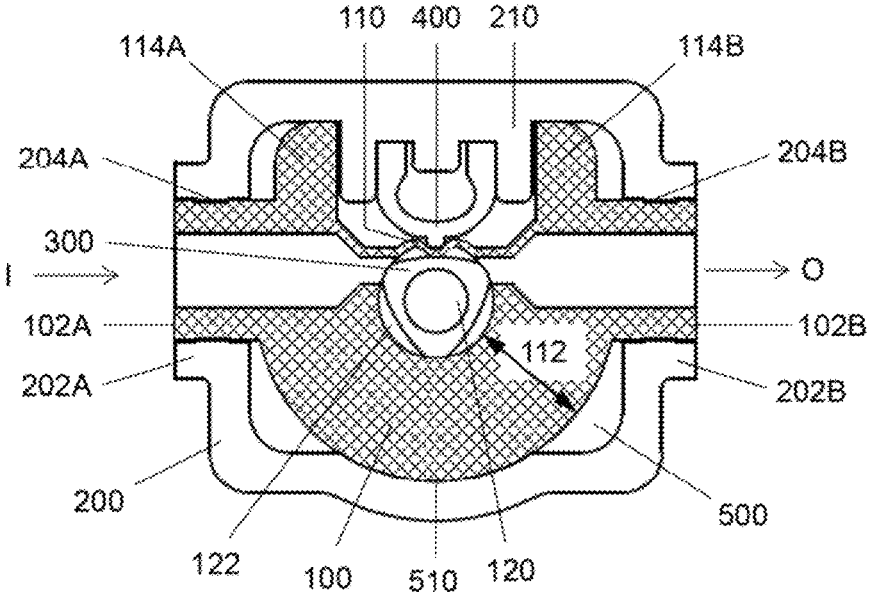
FIG. 1B shows a schematic cross section view through the pump assembly in the plane A-A, which is perpendicular to the longitudinal axis about which the rotor will rotate in use (in other words, a radial or lateral plane)
Figure 1C:
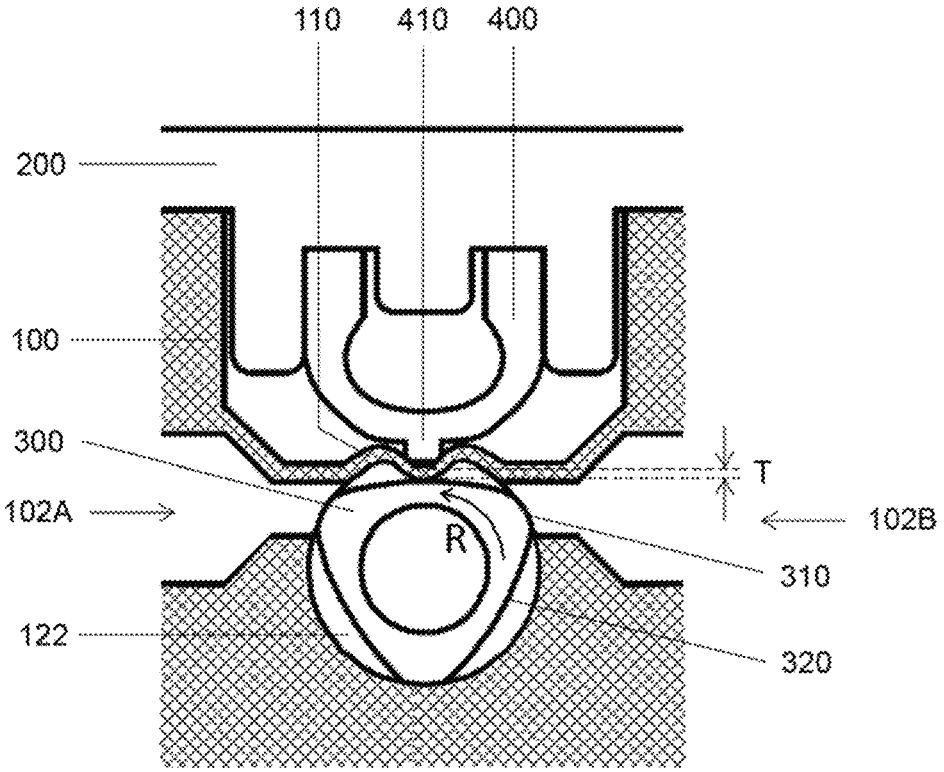
FIG. 1C shows a schematic expanded view of a central area of the cross section view in FIG. 1B.

FIGS. 1B and 1C show schematic cross section views through the plane A-A indicated in FIG. 1A, parallel to the direction in which fluid will be pumped from the inlet device I to the outlet device O (I and O are indicated but not shown in FIG. 1B). The support frame 200 will fit around the housing 100, with the ports 202A, 202B mechanically attached to the respective inlet and outlet tubes 102A, 102B by means of respective ribs 204A, 204B projecting from the ports 202A, 202B into correspondingly configured circumferential depressions provided on the inlet and outlet tubes 102A, 102B.

In this example, the rotor 300 comprises a pair of opposite ends through the centres of which the longitudinal axis L of rotation passes, the ends being connected by a side surface that is coaxial with the longitudinal axis L. The side surface comprises a radially outer housing-engaging surface area 310 and a chamber-forming surface area 320 radially inward from the housing-engaging surface 310. In the illustrated example, the entire housing engaging surface area 310 is at a uniform radial distance from the axis (in other words, the housing-engaging surface area 310 would lie on a cylindrical surface), and the chamber-forming surface areas 320 describe a geometrically more complex profiled shape, which may be referred to as "saddle-shaped".

Figure 1D:
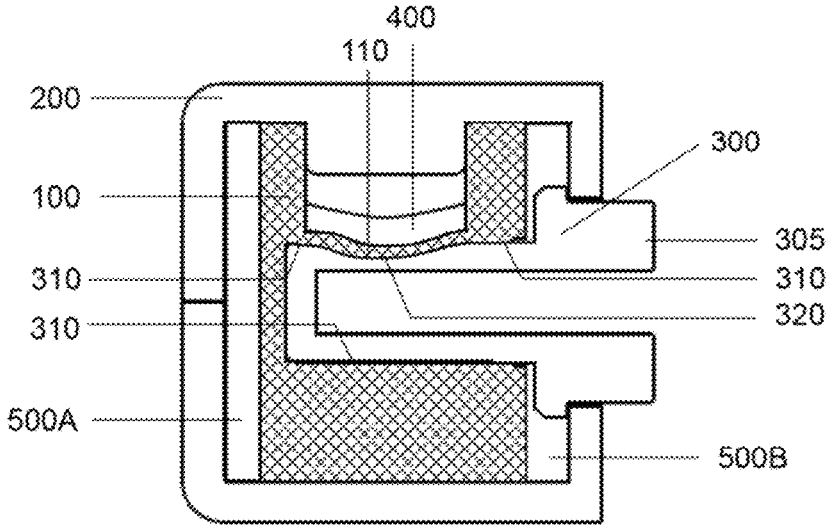
FIG. 1D shows a schematic cross section view through the pump assembly in the longitudinal plane B-B, which is parallel to the longitudinal axis about which the rotor will rotate in use.
Figure 1E:
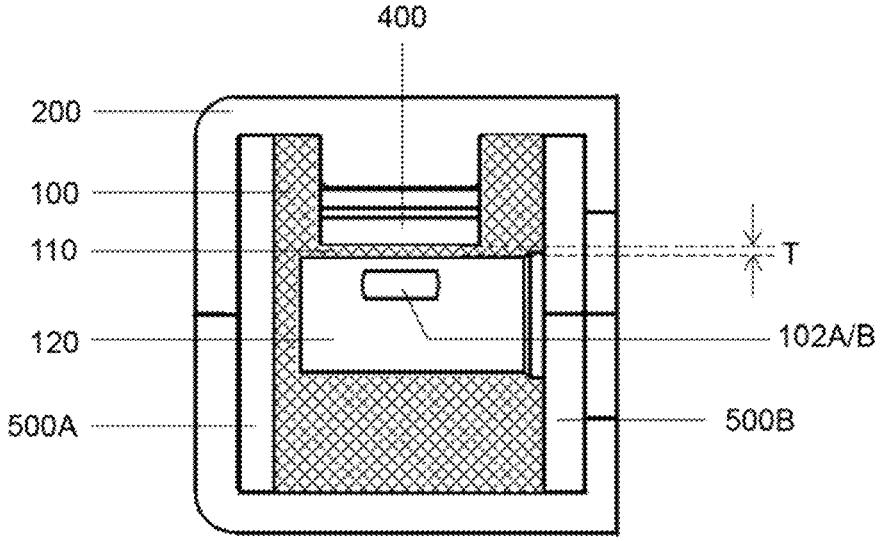
FIG. 1E shows the view illustrated in FIG. 10, but without the rotor being present.

FIGS. 1B and 1C show cross sections through the central radial plane A-A, showing the shape profiles of the housing-engaging 310 and chamber-forming 320 surface areas of the rotor in this plane A-A. In the example illustrated, the rotor 300 comprises three azimuthally equidistant chamber-forming surface areas 320, azimuthally spaced apart by three housing-engaging surface areas 310. In this example, the housing-engaging surface areas 310 form a contiguous housing-engaging surface, which surrounds each of the three chamber-forming surface areas 320, as can be seen from the orthogonal views shown in FIG. 1C and FIG. 1D. FIG. 1D shows the cross section view in the plane B-B, through the longitudinal axis L, showing a longitudinal shape profile of the housing-engaging 310 and chamber-forming 320 surface areas in this plane B-B. When viewed in central lateral cross section A-A, the chamber-forming surface area 320 has a convex profile, the mean tangential radius of which is substantially less than that of the housing-engaging surface area 310. When viewed in central axial cross section B-B, the chamber-forming surface area 320 has a concave profile.

The pump assembly includes a resilient biasing mechanism in the form of a generally elongate 'U'-shaped member 400 consisting of elastomer material and extending along an axis parallel to the longitudinal axis L. A proximal side of the biasing member 400 comprises an elongate central rib 410, and will bear against the diaphragm portion 110, and a distal side will bear against a seat portion 210 of the support frame 200. The seat portion 210 comprises a pair of parallel, longitudinally extending slots for accommodating the feet of the biasing member 400, and the seat portion 210 is configured to hold the distal side of the biasing member 400 substantially stationary relative to the adjacent side wall portions 114A, 114B when the rotor rotates as in use. The proximal portion of the biasing member 400 will be free to reciprocate radially in response to the rotor 300 rotating against a central region of the diaphragm portion 210 in use. The biasing member 400 will apply a radial force to the diaphragm portion 210 to flex it against the side surface of the rotor 300 with sufficient force that fluid cannot pass between the diaphragm portion 210 and the surface of the rotor 300 in use.

In the illustrated example, the support frame 200 contacts the external surface of the housing 100 adjacent the ends of the inlet and outlet portions 102A, 102B, at the side walls 114A, 114B, and at a supported external surface area 510 diametrically opposite the biasing mechanism 400. The support frame 200 is spaced apart from other areas of the external surface of the housing 200 to allow the unsupported surface area to distend freely within an air gap 500 in response to the rotation of the rotor 300. In FIGS. 1D and 1E, air gaps 500A, 500D are shown at opposite axial ends of the pump. The support frame 200 abuts the supported external surface area 510 to apply a counter-balancing reaction force to the housing 100, in response to the reciprocation of the proximal side resilient biasing means 400.

Each of the three chamber-forming surface areas 320 is spaced apart from the interior surface of the housing 100, which defines the cavity 120, except for the diaphragm portion 120, which will be pressed against the chamber-forming surface area 320 rotating past it. The chamber-forming surfaces 320 will thus form respective chambers 122 with the interior surface, which can contain a volume of liquid (if the liquid contains medication to be delivered to a patient, each volume may be referred to as a bolus). Since the housing-engaging surface area 310 surrounding the chamber-forming surface areas 320 will form a seal against the interior surface of the housing 100, each volume of liquid will be contained within each chamber 122 as it is conveyed about the cavity 120 from the inlet portion 102A to the outlet portion 102B, on rotation of the rotor 300. The biasing member 400 will urge the diaphragm portion 110 against the housing-engaging and chamber-forming surface areas 310, 320 of the rotor 300 as it rotates. The diaphragm portion 110 will thus be variably flexed between the resilient biasing member 400 and the rotor 300, both of which bear against it, on opposite sides. The maximum pressure of fluid within the outlet portion 102B is regulated by the pressure applied to the diaphragm portion 110 by the biasing member 400. Since the shape profile of the chamber-forming surface areas 320 may be complex and constantly changing in use as the rotor 300 rotates, the diaphragm portion 110 will need to be sufficiently flexible for its shape to be change continually. The radial contact force between the diaphragm portion 110 and the housing-engaging and chamber-forming surface areas 310, 320 of the rotor 300 will be sufficiently great along its entire length to prevent the pumped fluid at a desired pressure from passing between the diaphragm portion 210 and the rotor 300.

In use, the rotor 300 will be inserted into the housing 100 and driven by a drive mechanism (not shown) to rotate in the direction R about its longitudinal axis L. The inlet portion 102A supported by the respective port 202A of the support frame 200 will be connected to a fluid conveying device, such as a tube, from which fluid will flow into the inlet portion 102A. The chamber 122 can receive fluid from the inlet portion 102A when the rotor 300 is oriented such that a chamber 122 is in fluid communication with the inlet portion 102A; and when the chamber 122 comes into fluid communication with the outlet portion 102B, the volume of fluid within it will be discharged from the chamber 122 as the rotor 300 rotates and the fluid is prevented from passing between the diaphragm portion 110 and the rotor 300 under the action of the resilient biasing member 400 which ensures that the diaphragm portion 110 seals against the surface of the rotor 300 along its entire longitudinal extent. In other words, the volume of fluid in the chamber 122 will be squeezed out of the chamber 122 as the latter is rotated past the outlet portion 102B. The outlet portion 102B supported by the respective port 202B of the support frame 200 will be connected to another fluid conveying device into which fluid will flow from the outlet portion 102B. In this way, relatively accurate discrete doses of the fluid can be pumped, the total dose pumped depending on the volumes of the chambers 122, the number of chambers 122 (there are three chambers in this particular example), the number of revolutions of the rotor 300, and the rotational speed of the rotor 300.

In a particular example pump assembly, the rotor 300 may have a circumscribed diameter of about 3 mm (which would also be the approximate diameter of the cavity 120), the diaphragm portion 110 may have a substantially uniform thickness of about 0.25 mm and a base wall portion 112 may have a thickness of about 3.0 mm (the ratio of thickness of the base wall portion 112 to the thickness T of the diaphragm portion may be 12:1). In another example, the thickness T of the diaphragm portion 110 may be about 0.1 mm, and so the ratio of thickness of the base wall portion 112 to the thickness T of the diaphragm portion may be 30:1. In some examples, the thickness T of the diaphragm portion 110 may be about 1.0 mm, or in the range 0.1 to 1.0 mm. In general, the thickness T of the diaphragm portion 110 and that of the base wall portion 112 may both vary such that the ratio of the former to the latter is at least about 1:50 or at least about 1:20, and at most about 1:4. A relatively thin diaphragm portion 110 may exhibit greater flexibility in use, but may require that the side and base wall portions 114A, 114B, 112 is sufficiently thick to support it and hold its side boundaries in place during use.

In some examples, the housing 100 may consist of polypropylene, the thickness T of the diaphragm 110 may be about 0.1 mm, and the base wall portion 112 may be about 1.5 mm thick; and in some examples in which the resilient material may consist of rubber having a substantially lower Young's modulus, the thickness T of the diaphragm portion 110 may be about 0.5 mm and that of the base wall portion 112 may be 5 mm.

Figure 2:
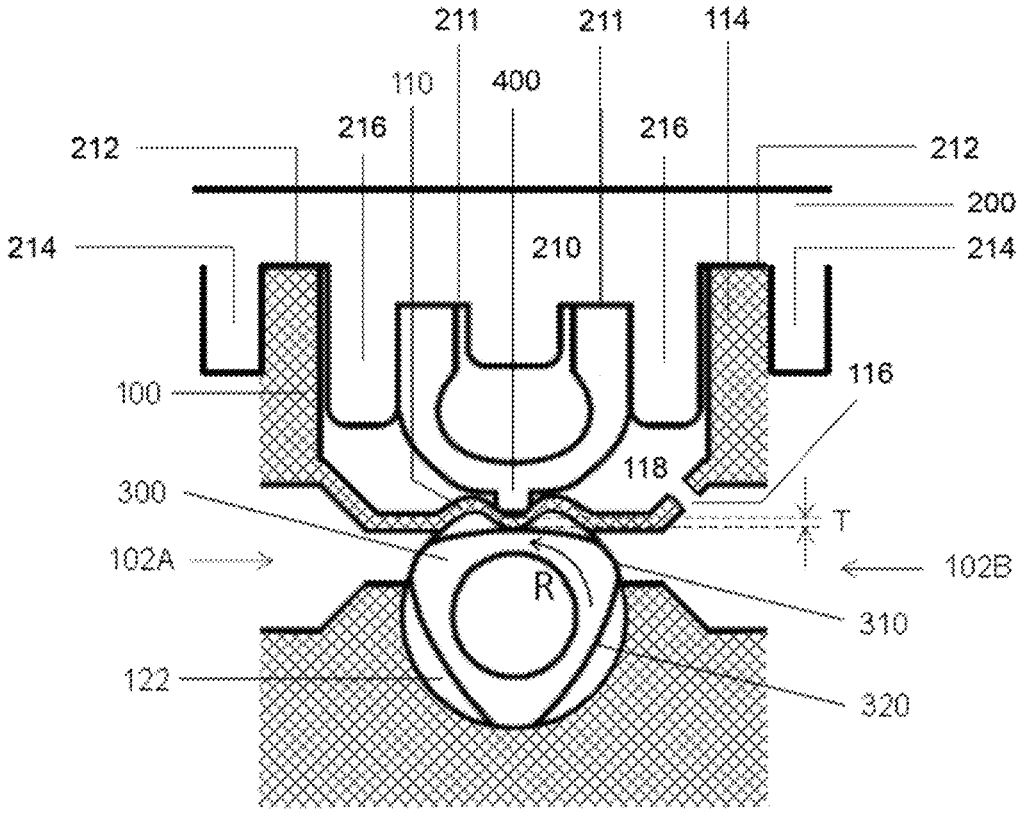
FIG. 2 shows a schematic expanded cross-section view of part of an example pump, the cross-section being perpendicular to the axis of rotation of the rotor

FIG. 2 shows a schematic expanded cross-section view of a central region of an example pump. This example pump comprises many of the same features as that described with reference to FIG. 1A to FIG. 1E. However, the diaphragm portion 110 includes an aperture 116 through it. The aperture 116 places the outlet portion 102B in fluid communication with a cavity volume 118 that is coterminous with the side of the diaphragm portion 110 against which the biasing member 400 bears (which may be referred to as the "underside" of the diaphragm portion). This example arrangement would result in the presence of pumped fluid within the cavity volume 118, the pressure of the fluid being the same as that in the outlet portion 102B. Therefore, the diaphragm portion 110 would be urged against the rotor 300 by both the biasing member 400 and fluid at the pressure of pumped fluid. This arrangement may have the aspect of increasing the pressure of the fluid that can be pumped into the outlet portion 102B without passing between the diaphragm portion 110 and the rotor, from the outlet portion 1028 to the inlet portion 102A.

In this example arrangement shown in FIG. 2, the support frame 200 comprises a seat portion 210 configured for receiving a pair of feet on the distal side of an elongate "U"-shaped biasing member 400 (the proximal side of which includes a projecting rib 410 that will bear against the diaphragm portion 110). The seat portion 210 comprises a pair of grooves 211 for receiving the feet, and a pair of slots 212 for receiving elongate side wall portions 114 of the housing 100 proximate the diaphragm portion 110. The slots 212 for each side wall portion 114 is defined by a pair of substantially parallel or aligned respective walls 214, 216 formed on the support frame 200. Each of the distal feet of the biasing member 400 will thus be spaced apart from a respective side wall portion 114 by a wall-like projection 216 of the support frame 200. The side wall portions 114 may be laterally supported by the wall-like projections 214 of the support frame 200. When this example pump is assembled, each of the two side wall portions 114 of the housing 100 would be inserted into a respective slot 212; and the distal feet of the biasing member 400 would be inserted into the adjacent groove 211. In other examples, there may be a single side wall portion 114, which may be circular, elliptical or rectilinear when viewed in a plan view. The distal side of the biasing member 400 will thus be held substantially statically in relation to the side wall portions 114 as the proximal side reciprocates against the diaphragm portion 110 in use, to flex it and urge it against the rotor 300 as the rotor 300 rotates.

Figure 3A:
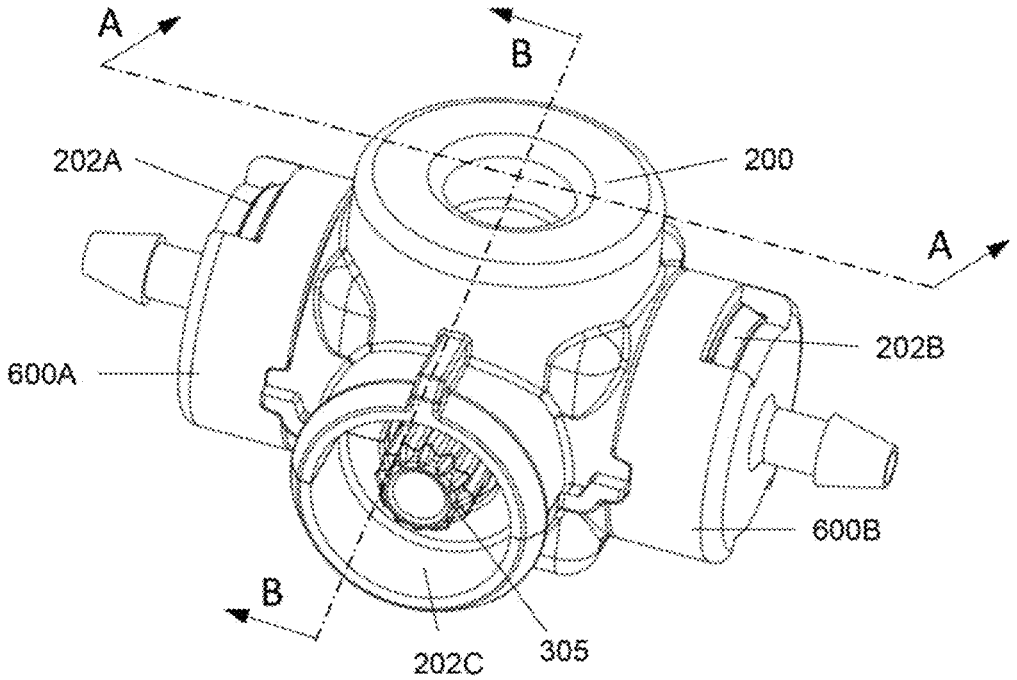
FIG. 3A shows a first schematic longitudinal cross-section perspective view of an example pump, the cross-section including a central cross-sectional plane of an example resilient biasing mechanism.
Figure 3B:
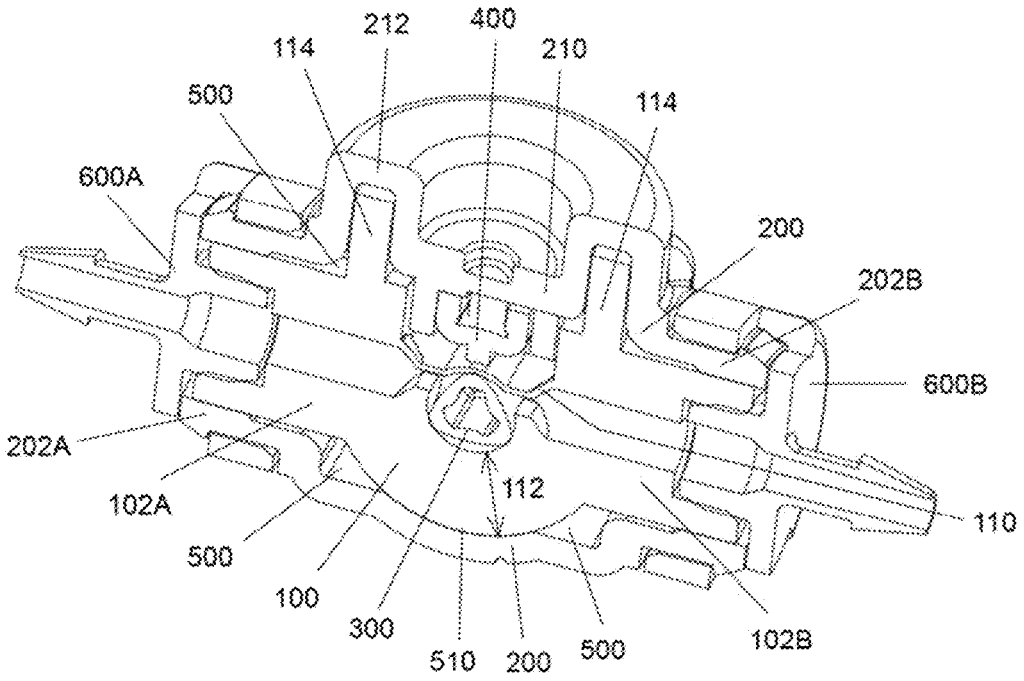
FIG. 3B shows a second schematic longitudinal cross-section perspective view A-A of the example pump of FIG. 3A, the cross-section being perpendicular to the first view.
Figure 3C:
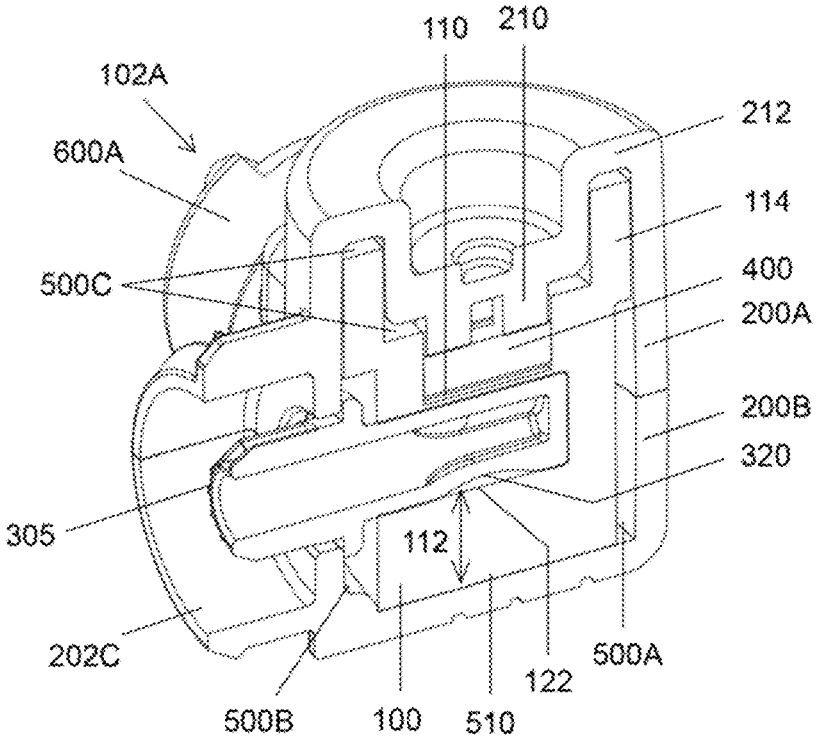
FIG. 3C shows a schematic lateral cross-section perspective view B-B of the example pump of FIG. 3A (the cross-sections shown in FIG. 3A-3C are mutually orthogonal)

FIG. 3A-3C show different perspective and cross-section views of an example pump, in which the same reference numbers refer to the same general features in FIG. 1A-FIG. 2. In this example, the support frame 200 is attached to the inlet and outlet portions 102A, 102B of the housing 100, and a pair of fitting 600A, 600B are attached to respective portions 202A, 202B of the support frame 200. In this example, the inlet and outlet portions 102A, 102B are coaxial and project from opposite ends of the housing 100. The support frame 200 consists of a pair of opposing fame members 200A, 200B, which can be attached to each other (by a mechanical clip mechanism, for example) enclose most of the housing 100. In this example, each fitting 600A, 6006 comprises male coupling mechanism for mating with a corresponding female coupling mechanism that will be attached to or formed as part of a fluid carrying device (not shown) such as a tube. The portions 202A, 202B of the support frame attached circumferentially about the inlet and outlet portions 102A, 102B, respectively, comprises an attachment mechanism for attaching the fittings 600A, 600B.

The support frame 200 comprises an attachment dock 202C for a rotor drive mechanism to couple with a splined mechanism 305 attached to the rotor 300, to rotate the rotor 300 in use. The support frame 200 thus holds the inlet and outlet portions 102A, 102B (and the pair of fitting 600A, 600B) firmly in place relative to one another, and relative to the rotor drive mechanism to which it can be secured, and which can be held stationary in use relative to the inlet and outlet fluid carrying devices (not shown). Thus, the support frame 200 can rigidly connect the inlet and outlet portions 102A, 102B with the rotor drive mechanism, and will remain stationary as the rotor 300 rotates in use because it is stiff enough to counter-balance the torque applied by the rotor 300 onto the housing 100.

With reference to the cross-section views shown in FIGS. 3B and 3C, an annular side wall portion 114 of the housing 100 projects outward from the adjacent the diaphragm portion 110 (coaxial with an axis that is perpendicular to the rotor axis) and is accommodated by an annular slot 212 formed by the support frame 200. A seat portion 210 of the support frame 200 abuts a distal side of a resilient biasing member 400 in the general form of an elongate "U"-shape, a proximal side of which bears against the diaphragm portion 110. In this example, the side wall portion 114 projects outwardly beyond the seat portion 210. The support frame 200 is thus configured to substantially prevent the side wall portion 114 from moving laterally relative to the distal side of the biasing member 200, and indirectly provides support for the side boundaries of the diaphragm portion 110, to which the side wall 114 is adjacent. The support frame 200 contacts an external surface area of the housing at 510 on the opposite side of the housing 100 to the diaphragm portion 110, to counter-balance the forces arising from reciprocation of the proximal side of the biasing member 400 in response to the rotation of the rotor 300 in use. However, the support frame is spaced apart from the external surface of the housing 100 at various places 500, 500A, 500B, 500C (and other locations) wherever contact is not advantageous for balancing forces. For example, the circular side wall portion 114 can reciprocate somewhat within the slot 212 formed by the support frame 200, owing to gaps 500C. This allows for the housing 100 to distend cyclically in use wherever possible and reduces the dimensional tolerances required for manufacturing the support frame 200. However, the support frame 200 does not provide gaps that would allow the housing 100 to move or distort azimuthally about the rotor axis in use.

The graphs in FIGS. 4A, 4B and 4C show example curves of flow rates F (in millilitres per second, $ml \cdot s^{-1}$) of pumped fluid versus the diameter D (in millimetres, mm) of example rotors (in other words, the diameters of circles that will circumscribe the rotor in the radial plane), for each of the rotor rotation speeds of 1, 5 and 10 revolutions per second (r.p.s.). In general and all else being equal, the pumped flow rate will be proportional to the rotation rate of the rotor. These curves correspond to pump assemblies having substantially the configuration described with reference to FIG. 1A to FIG. 1E. These example curves may represent lower limits of the potential performance of example pump assemblies, and the flow rates F may be substantially higher, for example up to about 50% higher in practice. In the example pump assemblies for which the curves are shown, the cavity is generally cylindrical (and the rotor can be circumscribed by a cylinder), and the length of the axial length of the chamber-forming surface area of the rotor is double the diameter D. In other examples, the diameter D may be half of L to ten times L (½ L to 10 L).

In some examples, the diameter of the cavity 120 may be about 1 mm, about 3 mm or about 5 mm. In certain examples in which the diameter of the cavity 120 may be about 5 mm, the thickness T diaphragm portion may be about 3 mm, supported by an base wall portion 112 having thickness of at least about 12 mm. In some examples of small pumps, in which the cavity 120 has a diameter of about 1 to 3 mm, the resilient material may consist of soft rubber having Young's modulus of as low as about 4 MPa, and/or have about 70 Shore A hardness at low strain. In some examples, the mean diameter of the cavity may be about 3 mm and the elastic, tensile or flexural modulus may be about 150 MPa.

In order for the diaphragm portion to be flexible enough to follow the contour of the surface areas of the rotor as it rotates, the diaphragm portion can be moulded with a very thin wall section. By careful processing using temperature and pressure feedback sensors and local venting to eliminate gassing it is possible to achieve diaphragm portions with a wall thickness of about 0.1 to 0.3 mm. In an example process, a sliding portion of an injection moulding tool that will create the outer surface of the diaphragm portion may be controlled independently or as a consequence of the tool opening and closing. In some examples, molten plastic may be injected into the tool by an injection screw, the diaphragm portion wall thickness being approximately twice the desired thickness in order to allow for some of the molten material to flow across the diaphragm portion. In some examples, the sliding portion of the tool may be advanced at the desired time within the injection cycle to create the desired diaphragm portion wall thickness without knit lines and creating sufficient packing pressure at the same time. The use of a single shot moulding process may exhibit the aspects (separately or in combinations) of reducing the number of manufacturing processes, having a faster cycle time, requiring simpler mould tools and mould machinery and leading to higher manufacturing yield and lower production costs than a two-shot process. Pumps formed in a single-shot moulding process may have the aspect of having a longer operational life.

In some examples, the diaphragm portion and the rest of the housing may comprise or consist of elastomeric material by a process including a single shot injection moulding process. The diaphragm portion and the rest of the housing may comprise or consist of thermoplastic material. For example, the housing material may comprise or consist of polyethylene, polypropylene, rubber modified polypropylene, plasticised polyvinyl chloride (PVC), or thermoplastic co-polyester elastomer such as Hytrel® (commercially available from DuPont®).

In general, the smaller the housing, the softer should be the resilient material of which the housing is formed. In some examples, the housing material may have nominal Shore D hardness (durometer hardness) of at most about 50, at most about 40 or at most about 30 as measured using the ISO 868 standard method (15 s). The housing material may have nominal Shore D hardness of at least about 5. In some examples, the housing material may have nominal Shore A hardness (durometer hardness) of at most about 50, at most about 40 or at most about 30. The housing material may have nominal Shore D hardness of at least about 10, or at least about 20. For example, depending on the size of the pump (the diameter of the cavity) and the fluid pressure, the material may have a hardness of 60 Shore A to 90 Shore D. In some examples, the housing material may have nominal Shore 00 hardness (durometer hardness) of at most about 80, at most about 60 or at most about 50. The housing material may have nominal Shore 00 hardness of at least about 5, at least about 10, or at least about 20.

General aspects of example disclosed pumps and pump assemblies will be explained below.

The sealing interference contact between the housing-engaging surface area and the interior surface will be able to contain the fluid within the chamber at the operating pressure. As the rotor rotates, so will the sealing interference contact, which will apply a torque onto the housing. In addition, the interference contact will induce hoop stress in the housing, and the housing may (reversibly) distend to some extent. The magnitude of the hoop stress that can be sustained by the housing will depend on the elastic modulus of the resilient material and the volume of the housing surrounding the cavity. In general, the higher the elastic modulus and the thicker wall of the housing, the greater the hoop stress that can be sustained, and the higher the pressure of the fluid that can be delivered by the pump.

The resilient material will have mechanical properties such that the diaphragm portion can be sufficiently flexed and deformed in use to maintain an effective seal against both the housing-engaging and the chamber-forming surface areas of the rotor as these surfaces rotate against the diaphragm portion. In some examples, the shape of the chamber-forming surface may be compound, and may include both concave and convex components (when viewed on different cross-sectional planes). Therefore, for a given thickness, length and width of the diaphragm portion, the resilient material will be selected to permit the degree of dynamic deformation required to prevent the pumped fluid from passing between it and the rotor (and thus to expel fluid from chamber into the outlet portion). In particular, the resilient material may be sufficiently soft and have a sufficiently low elastic or flexural modulus for the diaphragm portion to be reliably and repeatedly flexed in use, given its dimensions. Given the intrinsic mechanical properties of the resilient material, the configuration and volume of the housing (for example, the thickness of a base wall portion at least partly enclosing the cavity) will make it sufficiently stiff to maintain the sealing interference contact with the housing-engaging surface area of the rotor. In addition, movement of side boundaries of the diaphragm portion relative to the rotor axis may be resisted or substantially prevented as the diaphragm portion is dynamically flexed in use. However, to avoid the housing being undesirably large, its volume and stiffness may not be sufficient to counter-balance the torque applied by the rotor in use.

The flexibility of the diaphragm portion will likely be influenced by its shape and size, and the resilient material. In general, the thinner and wider the diaphragm portion, the greater its flexibility (all else being equal); also the softer the resilient material, or the lower its elastic, tensile or flexural modulus, the more flexible the diaphragm portion will likely be (all else being equal). In practice, there may be a technical or practical limitation to the lower limit of the mean thickness of the diaphragm, which may determine an upper limit to the elastic, tensile or flexural modulus, or the hardness of the resilient material that may be selected (all else being equal; for example, for a given fluid pumping rate). The selection of the resilient material will likely be especially important for relatively small pumps, particularly if a relatively high pumping rate is desired. The support frame may be particularly, but not exclusively, helpful for relatively small pumps, in order to avoid the need to make the housing volume undesirably large to achieve the stiffness required for effective operation.

To the extent that the minimum thickness of the diaphragm portion is limited by practical or technical considerations, the intrinsic flexibility of the resilient material will be adequately great for the extrinsic flexibility of the diaphragm portion to be sufficiently high. For example, it will have a suitably low elastic (e.g. Young's, flexural) modulus and/or hardness to provide a sufficiently flexible diaphragm portion. In certain examples, a lower limit of the thickness of the diaphragm portion may be set by the manufacturing method or apparatus used to mould the housing, or by a need to reduce the risk of the diaphragm portion tearing in use. If the diaphragm portion is too thin, then it may tend to distend excessively (which may be likened to a ballooning effect in extreme cases), and even if the pump continues to pump effectively, the accuracy of the volume of fluid pumped may be reduced. The volume of the housing (in particular, the thickness of its wall portions) may depend on the desired operating pressure of the fluid in the outlet portion, and may be calculated based on the hoop stress that will need to be sustained, given the elastic modulus of the resilient material of the housing.

In general and all else being equal, a diaphragm portion on a relatively small housing will likely be less flexible than a wider diaphragm portion of the same thickness on a relatively larger pump. Given the size of the pump (for example, as indicated by the diameter of the cavity, the rotor, the volume of the chamber), the resilient material may be selected in view of the lowest practical thickness of the diaphragm portion that can be injection or compression moulded, the required strength of the diaphragm portion and the required pressure that the diaphragm portion will need to sustain when it is urged against the rotor by the resilient biasing mechanism in use, which will depend on the pressure on the fluid being pumped into the outlet portion.

In some examples, there may be advantages for forming the inlet, outlet and diaphragm portions as portions of a single unit. For example, it may be technically easier or more efficient to form the housing by injection moulding.

On the one hand, the interference contact pressure between the interior surface of the housing and the housing-engaging surface area of the rotor will be sufficient to contain the pumped fluid within the chamber at the desired pressure; and on the other hand, the greater the contact force, the greater will be the power required to rotate the rotor at the desired rate, and the greater will be the torque applied by the rotor onto the housing. The use of the support frame as disclosed may have the aspect of reducing the volume of the housing that would be required to sustain the torque without rotating or being excessively distorted about the rotor axis. The interior surface may be reversibly impressed by the housing-engaging surface area, and a wall portion of the housing adjacent the interior surface may tend to expand radially to some degree, owing to its resilience. The support body may have the aspect of adequately maintaining the positions of the inlet, outlet and diaphragm portions in relation to the rotor axis and to each other, so that certain examples of the pump can operate effectively.

Some example pump assemblies may have the aspect that the presence of the support frame may reduce the risk of fluid leakage from the connection mechanisms by which the inlet and outlet portions can be coupled to respective fluid carrying devices.

In certain applications, it may be desired for the pump assembly to be as small as possible whilst the maximum pumping rate is as high as possible. In particular, the shaped chamber-forming surface area or areas may be radially deep into the rotor. A need for the rate of rotation of the rotor to be relatively high may require the diaphragm portion to be flexed in a complex way at relatively high frequency. Although making the diaphragm portion thinner will likely increase its flexibility for this purpose, there will likely be a practical limitation to the lower limit of its thickness, which may result from the method used to mould the diaphragm portion and the rest of the housing as a single, integral unit, and/or from risk of the diaphragm portion tearing. An approach may be to form the diaphragm portion from a softer material, and/or a material having a lower elastic modulus. However, the rest of the housing will be formed of the same material and there will likely be practical limitations to the flexibility of the housing, which will need to distend or distort slightly in response to the rotor surface contacting it in use, but which will need to be sufficiently stiff to sustain the hoop stress caused by the rotating rotor. The more flexible the housing, the greater the challenge of coupling the inlet and outlet portions to inlet and outlet devices such as tubes, especially if the pump is relatively small. In disclosed examples, this can be ameliorated by using a sufficiently stiff support frame or casing. In use, the housing may be significantly deformable and the frame may function as an external skeleton accommodating it and securing it to the inlet and outlet devices.

Certain terms and concepts used herein will be briefly explained below.

As used herein, in example arrangements of pumps or parts of pumps that have a generally cylindrical or conical shape, and therefore having a degree of cylindrical symmetry, the use of terminology associated with a cylindrical coordinate system may be helpful for describing the spatial relationship between features. In particular, a 'cylindrical' or 'longitudinal' axis may be said to pass through the centres of each of a pair of opposite ends and the body or a part of it may have a degree of rotational symmetry about this axis. Planes perpendicular to the longitudinal axis may be referred to as 'lateral' or 'radial' planes and the distances of points on the lateral plane from the longitudinal axis may be referred to as 'radial distances', 'radial positions' or the like. Directions towards or away from the longitudinal axis on a lateral plane may be referred to as 'radial directions'. The term 'azimuthal' will refer to directions or positions on a lateral plane, circumferentially about the longitudinal axis.

As used herein, a bolus is a depression or cavity formed in a rotor of a pump, which can transfer fluid from an inlet to an outlet. The maximum mass of the fluid that can be transferred in a single full rotation of the rotor will be determined by the number and volume of the bolus or boluses in the rotor, as well as the density of the fluid. Where a pump is used to deliver fluid for medical purposes, such as for infusion into a patient, the bolus is the smallest precise dosage of the fluid that can be delivered in practice. For example, the pump may be used to administer a specific amount of medication or other drug in fluid form to increase the level of a drug in a patient's blood.

Durometer or Shore hardness is one of several measures of the hardness of a material, particularly of polymer, elastomer and rubber materials. Hardness may be defined as a material's resistance to permanent indentation. There are various scales of Shore hardness, for example Shore OO, Shore A and Shore D, although there is no direct conversion among different scales.

As used herein, plastics may be referred to as synthetic resins and grouped as thermosetting resins and thermoplastic resins. Thermosetting resins include phenolic resin, polyamide resin, epoxy resin, silicone resin and melamine resin, which are thermally hardened and never become soft again. Thermoplastic resins include PVC (which may also be referred to as vinyl), polyethylene, polystyrene and polypropylene, which can be re-softened by heating. PVC is a thermoplastic comprising chlorine and carbon. Elastomer material is polymer material that exhibits both relatively high viscosity and elasticity, and generally has relatively low Young's modulus and high failure strain. Rubber is an example of elastomer material. At ambient temperatures (about 20° C. to 25° C.), elastomer materials are thus relatively soft and deformable.

As used herein, the stiffness of an object (which may also be referred to as its rigidity) is the extent to which it resists deformation in response to an applied force. An object described as stiff will deform relatively little when a given force is applied to it, and an object described as flexible or pliable will deform to a relatively greater degree under the force. Stiffness (and flexibility) is a property of an object and not a material as such; it will generally depend on the material or materials of which the object is comprised, as well as the object's shape and volume. Stiffness is an example of an extrinsic property. Properties of a material as such, for example as elastic modulus and hardness, are called intrinsic properties.

As used herein, a material, object or mechanism that is described as "resilient" will return to its original shape or configuration once a deforming force is no longer applied to it; it will exhibit elastic-like or spring-like behaviour and be reversibly deformable over a range of forces. When applied to a material, "resilience" is an intrinsic property of the material as such, and a resilient material will exhibit elastic properties within a range of forces applied to it. As used herein, a resilient material may consist of a mixture of materials, provided that the resultant effect of the mixture is to provide material that is resilient.

As used herein, the "torsional deformation" or simply "torsion" of an object is its twisting response to a torque applied to it.

As used herein, fluoroelastomer materials that may be commercially available under the brand name of Viton® include synthetic rubber and fluoropolymer elastomer materials, categorized under the ASTM D1418 and ISO 1629 designation of FKM. These include copolymers of hexafluoropropylene (HFP) and vinylidene fluoride (VDF or VF2), terpolymers of tetrafluoroethylene (TFE), vinylidene fluoride (VDF) and hexafluoropropylene (HFP) as well as certain perfluoromethylvinylether (PMVE). The fluorine content of the fluoroelastomer material may be 66% to 70%.

The invention claimed is:

1. A pump assembly for pumping fluid comprising:
- a housing,
- a support frame that is attachable to the housing, and
- a rotor that rotates within the housing;

the housing consisting of resilient material and comprising:
- an interior surface,
- an inlet portion including an inlet for the fluid,
- an outlet portion including an outlet for the fluid, and
- a diaphragm portion;

in which the housing and rotor are cooperatively configured such that when in use:
- a housing-engaging surface area of the rotor forms a sealing interference contact with the interior surface, and
- a chamber-forming surface area of the rotor disposed radially inward from the housing-engaging surface area forms a chamber with the interior surface;

and when the rotor rotates within the housing as in use:
- the chamber conveys fluid from the inlet portion to the outlet portion;
- the rotor applies a torque to the housing in response to the housing-engaging surface area rotating against the interior surface; and
- as the chamber-forming surface travels from the outlet to the inlet, the diaphragm portion bears against it the chamber-forming surface, thereby preventing fluid passing from the outlet to the inlet, and expelling the fluid from the chamber through the outlet portion; and in which
- the support frame is attached to a plurality of spaced-apart portions of the housing,
- the support frame at least partly encloses the housing, and includes respective ports for the inlet portion, the outlet portion and a rotor drive shaft, and
- the support frame counter-balances the torque applied to the housing by the rotor.

2. A pump assembly as claimed in claim 1, in which the housing is configured such that the diaphragm portion, or an area of the interior surface is located between the spaced-apart portions.

3. The pump assembly as claimed in claim 1, in which at least one of the spaced-apart portions comprises the inlet portion and at least one of the spaced-apart portions comprises the outlet portion.

4. The pump assembly as claimed in claim 1, in which at least one of the spaced-apart portions of the housing comprises the inlet portion and at least one of the spaced-apart portions of the housing comprises the outlet portion, and there is a gap between a rotor port portion of the support frame and an external surface of the housing, in which the rotor port portion of the support frame is configured and arranged to accommodate the rotor shaft, so that in use, the rotor is driven by an external drive mechanism to rotate.

5. The pump assembly as claimed in claim 1, in which the support frame is attachable to a wall portion of the housing, between the inlet and outlet portions.

6. The pump assembly as claimed in claim 1, comprising a plurality of support frames, cooperatively configured with each other and the housing, such that when in use, different support frames are attachable to different portions of the housing.

7. The pump assembly as claimed in claim 1, in which the support frame prevents the housing from being stretched or compressed in response to a force applied to the pump assembly by one or more fluid carrying devices attached to the housing.

8. The pump assembly as claimed in claim 1, in which the housing is configured such that it is not sufficiently stiff to resist being deformed and/or rotated about the axis of rotation of the rotor in response to the torque, when the inlet and outlet portions are connected to fluid carrying devices as in use.

9. The pump assembly as claimed in claim 1, in which the housing is configured such that it reversibly distends in response to the sealing interference contact with the housing-engaging surface of the rotor.

10. The pump assembly as claimed in claim 1, in which the support frame comprises respective coupling mechanisms for coupling the inlet and outlet portions to respective fluid carrying devices; and/or the pump assembly includes at least one coupling mechanism for coupling the inlet and outlet portions to respective fluid carrying devices.

11. The pump assembly as claimed in claim 1, in which the support frame is configured such that when in use, the support frame is spaced apart from an unsupported external surface area of the housing, operative to allow deformation of the unsupported external surface area in response to a distending of the housing by the rotor and the rotation of the rotor.

12. The pump assembly as claimed in claim 1, comprising a resilient biasing mechanism for flexing the diaphragm against the housing-engaging and chamber-forming surface areas of the rotor, in response to the rotation of the rotor; in which a proximal side of the resilient biasing mechanism bears against the diaphragm portion and reciprocates along a radial direction, and a distal side of the resilient biasing mechanism is seated against the support frame and held stationary relative to the housing.

13. The pump assembly as claimed in claim 1, in which the support frame is configured such that when in use, the support frame contacts a supported external surface area of the housing, operative to counter-balance reaction forces generated against the housing by the reciprocation of part of a resilient biasing mechanism in response to the rotation of the rotor.

14. The pump assembly as claimed in claim 1, in which the support frame comprises a groove configured for accommodating at least a portion of a resilient biasing mechanism for urging and flexing the diaphragm portion against the rotor in use.

15. The pump assembly as claimed in claim 1, in which the support frame comprises a slot for accommodating a wall portion of the housing that extends from adjacent the diaphragm portion.

16. The pump assembly as claimed in claim 15, in which the slot is configured operative to bear against the wall portion with sufficient force to contain fluid present within the housing.

17. The pump assembly as claimed in claim 1, in which the rotor comprises the rotor drive shaft.

18. The pump assembly as claimed in claim 1, in which the support frame comprises a driver attachment mechanism for attaching the support frame to a rotor driver mechanism.

19. The pump assembly as claimed in claim 1, in which the support frame comprises a plurality of frame members that can be assembled and disassembled.

20. The pump assembly as claimed in claim 1, comprising a plurality of support frames, each attachable to different external surface areas of the housing.

21. The pump assembly as claimed in claim 1, in which the support frame comprises a material selected from the group consisting of polypropylene, polycarbonate, phenolic or epoxy resin, acetal, polyvinyl chloride (PVC), acrylonitrile butadiene styrene (ABS) or nylon material.

22. The pump assembly as claimed in claim 1, in which the diaphragm portion has a mean thickness of 0.1 to 3.0 mm.

23. The pump assembly as claimed in claim 1, in which the housing comprises a base wall portion that extends azimuthally between the inlet portion and the outlet portion, and radially from the interior surface to an external surface area of the housing; and a volume of the base wall portion is lame enough to accommodate pumped fluid having a pressure of up to 700 kPa within the chamber as the chamber rotates from the inlet portion to the outlet portion.

24. A pump assembly as claimed in claim 23, in which the base wall portion has a mean thickness of at least 4 times the mean thickness of the diaphragm portion.

25. The pump assembly as claimed in claim 1, in which the resilient material comprises elastomer material or thermoset material.

26. The pump assembly as claimed in claim 1, in which the resilient material comprises a material selected from the group consisting of polyethylene, polypropylene, rubber modified polypropylene, plasticised polyvinyl chloride (PVC), or thermoplastic co-polyester elastomer, silicone rubber, butyl rubber, nitrile rubber, neoprene, ethylene propylene diene monomer (EPDM) rubber, and fluoroelastomer material.

27. The pump assembly as claimed in claim 1, in which the resilient material has a Young's, tensile and/or flexural modulus of 1 MPa to 1,500 MPa.

28. The pump assembly as claimed in claim 1, in which the resilient material has a nominal Shore D or Shore A hardness of 5 to 50; or a hardness of 50 Shore A to 90 Shore D.

29. The pump assembly as claimed in claim 1, in which at least part of the diaphragm portion travels a radial distance of 0.2 to 6 mm from contacting the chamber-forming surface area to contacting the housing-engaging surface area of the rotor as the rotor rotates in use.

30. The pump assembly as claimed in claim 1, in which the chamber-forming surface of the rotor is configured such that it exhibits a concave cross-section in all planes including the axis of rotation, and a convex cross-section in all planes perpendicular to the axis of rotation.

31. The pump assembly as claimed in claim 1, in which the housing and the rotor are configured to be capable of pumping fluid at a rate of at most 0.5 millilitres per second (ml/s) when the rotor rotates at 10 revolutions per second (r.p.s.).

32. The pump assembly as claimed in claim 1, in which the rotor comprises two or three chamber-forming surface areas, each configured to form a respective chamber having a capacity of 1 to 10 microlitres (μl), the pump assembly capable of pumping fluid at a rate of about 0.02 to 0.3 millilitres per second at a rotor rotation rate of about 10 r.p.s.

33. The pump assembly as claimed in claim 1, in which the mean diameter of the cavity is 1 to 50 mm.

34. The pump assembly as claimed in claim 1, in which the mean diameter of the cavity is 1 to 10 mm and the resilient material has a Young's, tensile and/or flexural modulus of at most 200 MPa.

35. The pump assembly as claimed in claim 1, in which the pump is symmetrical about a plane between the inlet and the outlet portions, and including the axis of rotation of the rotor; and the rotor can be driven to rotate in either direction about the axis, operative to selectively pump fluid from the inlet to the outlet, or from the outlet to the inlet, in response to the direction of rotation of the rotor.

36. The pump assembly as claimed in claim 1, provided in an unassembled kit form.

37. The pump assembly as claimed in claim 1, further comprising a fluid-carrier device connected to the pump assembly.

38. A fluid-conveyer assembly comprising the pump assembly as claimed in claim 1, and a fluid-carrier device configured for connection to the pump assembly.

39. A fluid-conveyor assembly as claimed in claim 38, in which the rotor comprises or is coupled to a rotor drive shaft;

the support frame comprises a plurality of interconnectable frame members; and the housing, support frame and rotor cooperatively configured such that when in use, the support frame is attached to the inlet and the outlet portions of the housing.

40. The fluid-conveyor assembly as claimed in claim 38, comprising:

an inlet coupling mechanism and an outlet coupling mechanism;

the inlet and outlet coupling mechanisms being cooperatively configured with the support frame and the housing, such that the inlet and outlet coupling mechanisms are attached to the support frame adjacent the inlet and outlet ports, respectively, operable for fluid to flow through the inlet coupling mechanism and into the inlet portion of the housing, and for pumped fluid to flow from the outlet portion of the housing and through the outlet coupling mechanism.

* * * * *